United States Patent [19]

Miyamoto et al.

[11] 4,297,263

[45] Oct. 27, 1981

[54] METHOD OF MAKING POLYPROPYLENE PRINTING PLATE USING PAPER MATRIX

[75] Inventors: Kinzo Miyamoto, Mitaka; Takayasu Tanaka, Tokyo; Yoshimi Inoue, Yokohama, all of Japan

[73] Assignees: Mitsui Toatsu Chemicals Inc., Tokyo; Kabushikikaisha Asahi Shinbunsha, Osaka, both of Japan

[21] Appl. No.: 669,817

[22] Filed: Mar. 24, 1976

[30] Foreign Application Priority Data

Apr. 2, 1975 [JP] Japan ..... 50-39262

[51] Int. Cl.[3] ..... C08K 5/20

[52] U.S. Cl. ..... 260/32.6 PQ; 101/395; 101/401.1; 264/225

[58] Field of Search ..... 260/32.6 PQ, 878 B; 526/6, 348; 101/395, 401.1

[56] References Cited

U.S. PATENT DOCUMENTS

| | | | |
|---|---|---|---|
| 3,328,486 | 6/1967 | Crawford | 260/878 B |
| 3,330,796 | 7/1967 | Mock | 260/32.6 PQ |
| 3,371,130 | 2/1968 | Seifert | 526/6 |
| 3,929,932 | 12/1975 | Castagna | 260/878 B |
| 3,944,530 | 3/1976 | Sugita | 264/99 |

*Primary Examiner*—Paul R. Michl

*Attorney, Agent, or Firm*—Hill, Van Santen, Steadman, Chiara & Simpson

[57] ABSTRACT

A method of making a polypropylene printing plate using a paper matrix in which a roll and an opposing member are prepared, a paper matrix is attached to one of the roll and opposing member, a crystalline ethylene-propylene copolymer having a MFI (melt flow index) of 3~10, containing ethylene less than 20% by weight and tensile yield strength of 220~330 kg/cm$^2$ is continuously fed under molten state between the roll and the opposing member, and then the crystalline ethylene-propylene copolymer is pressed and cooled to be hardened.

Further, a reproducing printing plates consists of a crystalline ethylene-propylene copolymer whose melt flow index is selected in a range of 3~10, which contains ethylene less than 20 weight % and which has the tensile yield strength of 220~330 kg/cm$^2$.

2 Claims, 3 Drawing Figures

METHOD OF MAKING POLYPROPYLENE PRINTING PLATE USING PAPER MATRIX

BACKGROUND OF THE INVENTION

1. Field of the Invention

The present invention relates generally to a method of making a polypropylene printing plate, and is directed to a method of making a polypropylene printing plate using a paper matrix.

The present invention is also directed to a reproducing printing plate made of a crystalline ethylene-propylene copolymer.

2. Description of the Prior Art

In order to print a newspaper, it is essentially required to produce a large number of newspapers at high speed. In the prior art, a so-called paper matrix-stereotype method has been employed in which a paper matrix is formed based upon an original plate, and molten lead alloy is cast into the paper matrix to form a reproduction printing plate which is mounted to a rotary press to carry out the printing of a newspaper. In the labor environment to handle lead alloy, there are many problems, which should be improved, such as those of operation at high temperature, lead poisoning, weight transportation and the like. Thus, there has recently been proposed a method of forming a printing plate by using thermoplastic resin. Its practical method is to make a printing plate of thermoplastic resin by using a paper matrix similarly as used in the prior art paper matrix-stereotype method in accordance to, for example, Japanese patent application publication No. 12933/1973, Japanese Pat. Laid-Open No. 33704/1974 or Patent Laid-Open No. 3959/1974. In this case, it has been known that as the thermoplastic resin it is most preferred to employ crystalline polypropylene whose melt flow index (hereinafter referred to as MFI) (JIS-K6758) is 3~10 and as the paper matrix it is suitable to employ one such as disclosed in Japanese utility model application publication No. 27601/1971 whose surface layer is superior in stripability and strongly sticks to its base body.

However, in the above described method, that is, the method of making a reproduction printing plate comprising the steps of mounting a paper matrix to either of a roll and its opposing member, supplying melt of crystalline polypropylene of MFI 3~10 to a clearance between the roll and opposing member, pressing the melt to the matrix, and cooling the melt to be hardened, there is a great problem in that the paper matrix life should be improved. That is, at a newspaper company having a large circulation, since a necessary number of newspapers must be printed and sent out for circulation in a limited short time period, it is required to operate a number of rotary presses for printing at the same time and hence many reproduction printing plates are needed. For example, according to a questionaire regarding the inspection standard for receiving paper flongs at newspaper plants (the interim report of Research Society, Special Technical Meeting, 1963, Japan Press Association), preferable number of casting the stereotype per one paper matrix in the paper matrix-stereotype printing method was more than 20 for 80% of plants, more than 30 for 60% of plants and more than 40 for 18% of plants.

When a polypropylene printing plate is made, such a paper matrix as disclosed in the above mentioned Japanese utility model application publication No. 27601/1971 is preferably employed, in which the surface layer of the paper matrix is selected to be superior in stripability and also the contact between the surface layer and base body of the paper matrix is made strong. However, there has not yet been sold such a paper matrix which is strong enough to always endure reproduction of 20~30 or more resin printing plates without being affected by conditions occurring in the case of pressing paper flongs on an original plate such as etched metal plate, type form, photopolymer plate or the like so as to make paper matrices. At present, when printing plates are reproduced by crystalline polypropylene, the paper matrix is endurable generally for about 15 plates and normally for about 7~10 plates.

In order to prepare a reproduction printing plate which faithfully reproduces even the details of a matrix, a resin having excellent flow property must be employed. Polypropylene of MFI 3~10, preferably of MFI 5~8 is suitable for the above purpose. However, a paper matrix mainly uses fiber in its material so that a great number of fine bores are formed therethrough. For this reason, when molten resin is pressed into concave portions of the paper matrix, the molten material is intruded into the fine bores to make the resin printing plate difficult to be stripped therefrom so that the paper matrix is damaged to decrease the number of reproduction printing plates. Thus, in order to further facilitate stripability of the paper matrix, it is sometimes coated with a suitable surface lubricant after the production of paper matrix. In this case, however, there is a drawback such that the fine bores of the paper matrix are clogged up by the surface lubricant to deteriorate the reproduction fidelity of printing plates. These fine bores function to exhaust therethrough air confined between the matrix and molten resin when a printing plate is formed, so that they are indispensable for providing high fidelity to the printing plate. Accordingly, maintaining air permeability of a paper matrix to enhance the reproduction fidelity of printing plates and keeping excellent stripability to improve the matrix life are necessary conditions for developing the paper matrix-resin printing method widely in the newspaper printing.

SUMMARY OF THE INVENTION

As a result of long years' research, we have found out a method of making a surprisingly large number of reproduction resin printing plates with a paper matrix being not damaged by using copolymer with specific property as the raw plastic material. Consequently, the present invention was completed.

According to an aspect of the present invention there is provided a method of making a polypropylene printing plate which has the steps of mounting a paper matrix onto either of a roll and its opposing member, feeding crystalline ethylene-propylene copolymer of MFI 3~10, ethylene content less than 20 weight % and tensile yield strength 220~330 kg/cm$^2$, continuously between the roll and opposing member under molten condition, and pressing and cooling the same to be hardened, Accordingly, it is an object of the present invention to provide a novel method of making a polypropylene crystalline printing plate.

It is another object of the invention to provide a method of making a polypropylene printing plate with which a number of reproduction printing plates can be made without damaging the paper matrix.

It is a further object of the invention to provide a reproducing printing plate made of a crystalline ethylene-propylene copolymer.

The other objects, features and advantages of the present invention will become apparent from the following description taken in conjunction with the accompanying drawings.

DESCRIPTION OF THE PREFERRED EMBODIMENTS

Figure 1:
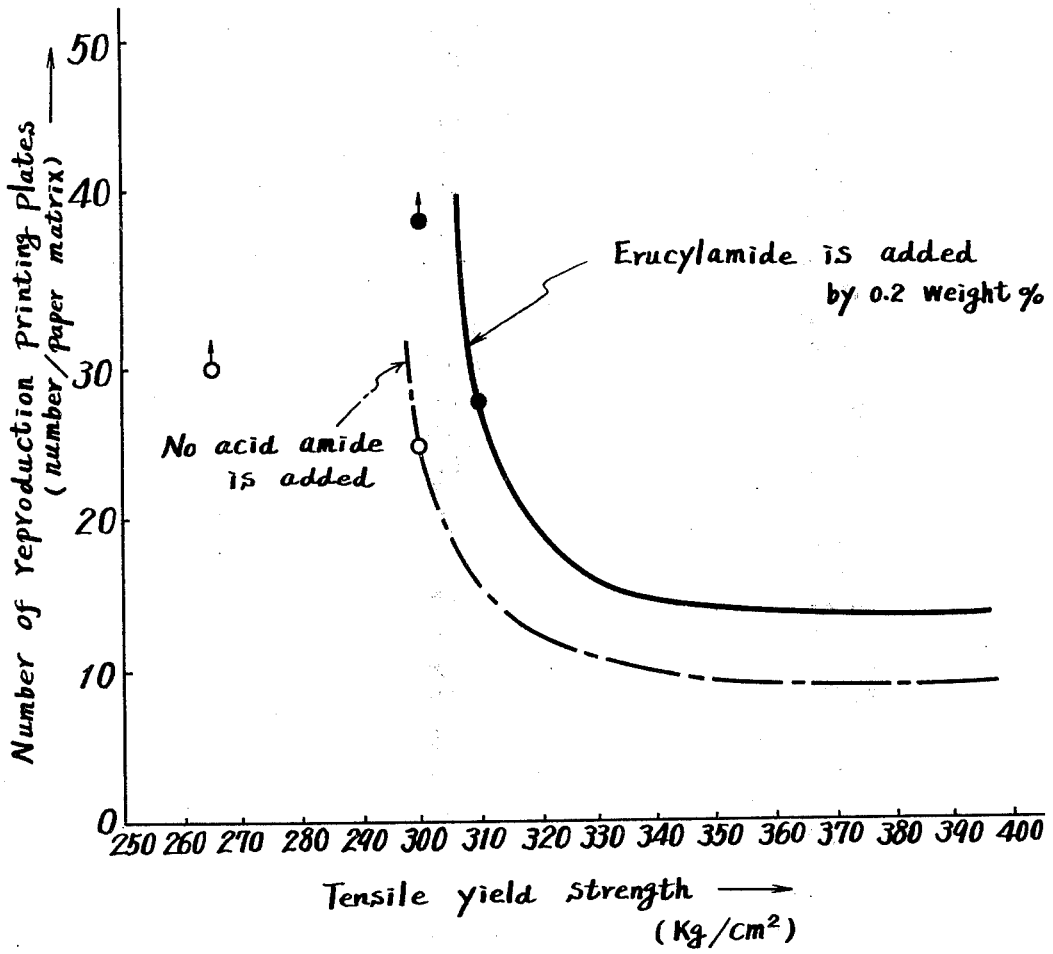
FIG. 1 is a graph used for explaining the present invention.

The present invention will next be described in detail. In this invention, it is based upon the prior art knowledge that MFI of copolymer to be used is selected to be 3~10 as its most suitable range. Further, the tensile yield strength (JIS-K6758, the speed of testing being made as 30 mm/min in this case) is selected to be 220~330 kg/cm$^2$, because the number of reproduction printing plates from one paper matrix is extremely superior in a range less than 330 kg/cm$^2$ as shown in an attached figure.

The number of reproduction printing plates is increased as mentioned above depending on the effect of function such that the copolymer intruded into the fine bores in the surface layer of a paper matrix can be removed therefrom with the copolymer itself being extended and deformed before being peeled off from the surface layer of the paper matrix thereby to prevent the paper matrix from being damaged.

The attached Figure or graph shows the life of a paper matrix (relationship between tensile yield strength and number of reproduction printing plates from one paper matrix) in a case of using as the matrix a paper flong according to the aforesaid Japanese utility model application publication No. 27601/1971 and employing crystalline ethylene-propylene copolymer with ethylene content less than 20 weight % and tensile yield strength 220~330 kg/cm$^2$.

Further, ethylene-propylene copolymers with tensile yield strength less than 220 kg/cm$^2$ is greatly defective in folding endurance of self hinge, wear proof, heat resistance and stability on a rotary press in the same manner as copolymer with ethylene content more than 20 weight % which will be described later and hence not suitable as a newspaper printing plate. In addition thereto, a resin plate pressed to the paper matrix becomes difficult to be stripped off from the matrix surface unless it is carefully cooled, so that plate production speed must also be made very slow.

In general, crystalline polypropylen tends to have tensile yield strength such that propylene homopolymer is in a range of more than 330 kg/cm$^2$ and ethylene-propylene copolymer is in a range of 180~350 kg/cm$^2$. The propylene homopolymer seldom has tensile yield strength less than 330 kg/cm$^2$. In this case, it is mostly of molecular weight of polymer with MFI less than 3 and inferior in flow property, so that it is not suited to the purpose of this invention. In the ethylene-propylene copolymer, its tensile yield strength is greatly changed widely in accordance with its ethylene content, combination mode of ethylene and propylene such as random copolymer or block copolymer, and the like. Particularly, the block copolymer exhibits wide variation in tensile yield strength. As the ethylene content increases, the random copolymer lowers its crystal property and approaches an elastic material. When the ethylene content becomes 20 weight %, no crystal is found therein, so that the random copolymer is too soft to be suitable for with the material for a printing plate. In addition, the block copolymer with ethylene content more than 20 weight % is scarcely sold on the market and hence it is noticed that polymer preparing process is difficult. Further, the block copolymer with ethylene content exceeding 20 weight % will have a large portion which can not be completely filled in the concave portions of the paper matrix and hence the printing plate reproduction fidelity thereof is deteriorated. Besides, the folding endurance of self hinge, which is one of the characteristics of polypropylene, is remarkably lowered. As a result, when self hinges are attached to the top and bottom of a printing plate which is then mounted on a printing cylinder of a rotary press with tension being applied to the printing plate by the tension lock method so as to print a great number of newspapers, the printing plate can not bear repetitive stress and is sometimes cut off at its hinged portion.

Furthermore, wear proof and heat resistance thereof are also lowered. As to the wear proof, the printing plate can not withstand the printing of 20,000~30,000 copies and is worn out by the papers. As to the heat resisting property, the plate can not stand the increasing temperature and pressure during the printing operation of the rotary press and hence the stability of printing plate can not be maintained.

In a case of using a blend resin of propylene homopolymer and polyethylene such as to satisfy the necessary condition of this invention, the short life of paper matrix to the former polymer appears strongly and hence an effect of improving the matrix life could not be noticed.

As mentioned above, the crystalline ethylene-propylene copolymer according to this invention can contain crystal nucleating agent, antioxidant and other blending agent so far as the conditions for MFI, ethylene content and tensile yield strength are satisfied. However, it should be noticed that when acid amide used as lubricant in resin blending agent is normally contained therein, the paper matrix life for casting can be greatly improved. Thus, blending of ethylene-propylene copolymer and acid amide is effective for the matrix life so that it may be considered to have a synergistic effect. As an effective acid amide, there are considered amides of higher saturated fatty acid, unsaturated fatty acid and hydroxylated fatty acid having carbon number of 8~26, in which are included octylamide, lauryl-amide, palmityl amide, stearyl amide, oleyl amide, erucyl amide, methylenebisstearylamide, ethylenebisstearylamide and the like. The adding amount thereof less than 1 weight % is sufficiently effective for the copolymer, and even though the adding amount is increased more, the notable improvement in effect can not be recognized. Contrarily, in this case, a stink of smoke generated when printing plates are reproduced becomes strong and deteriorates the operating circumstances and further the blending agent is sometimes filled in the fine bores of paper matrix to lower the printing plate reproduction fidelity. The blending amount of acid amide is preferably 0.05~0.5 weight %.

The resin printing plate made by the above mentioned method of this invention was unexpectedly improved in printing effect as mentioned below. That is, since the plate surface is made of ethylene-propylene copolymer, it is more flexible and elastic than that made of propylene homopolymer and transfer characteristic of ink is improved so that much beautiful printing finish may be obtained on the newspaper surface. Further, in the case when acid amide is added, the acid amide blooms on the plate surface to improve the transfer characteristic of ink. In addition, it was found that the more the blending amount is, the superior is the improvement effect.

Figure 2:
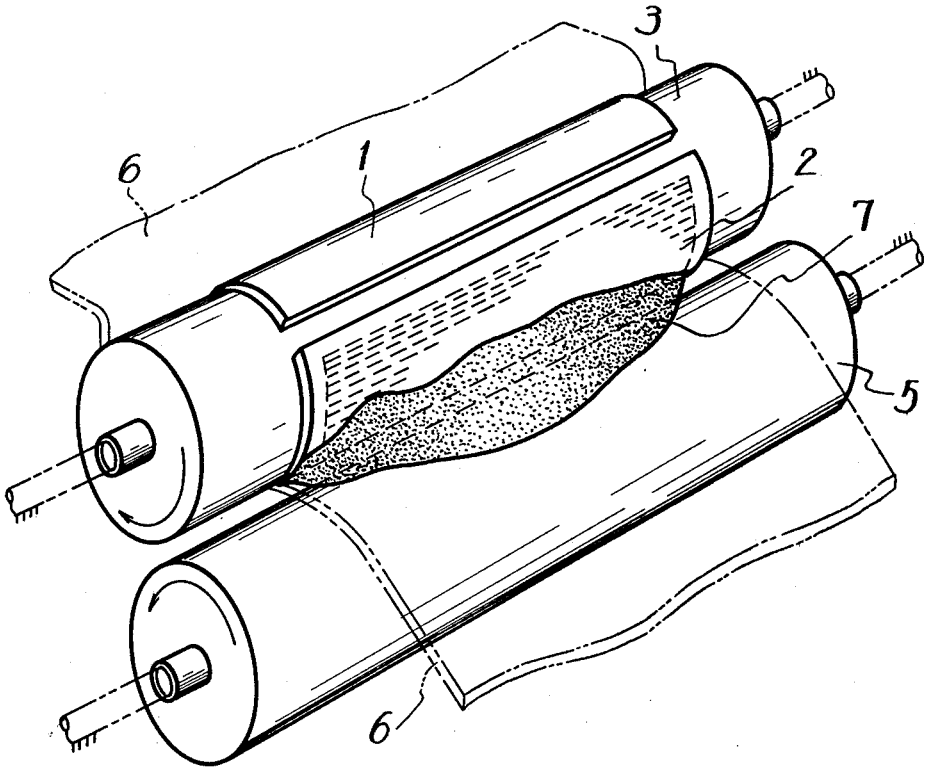
FIGS. 2 and 3 are schematic diagrams showing an example of apparatus used for carrying out the invention.
Figure 3:
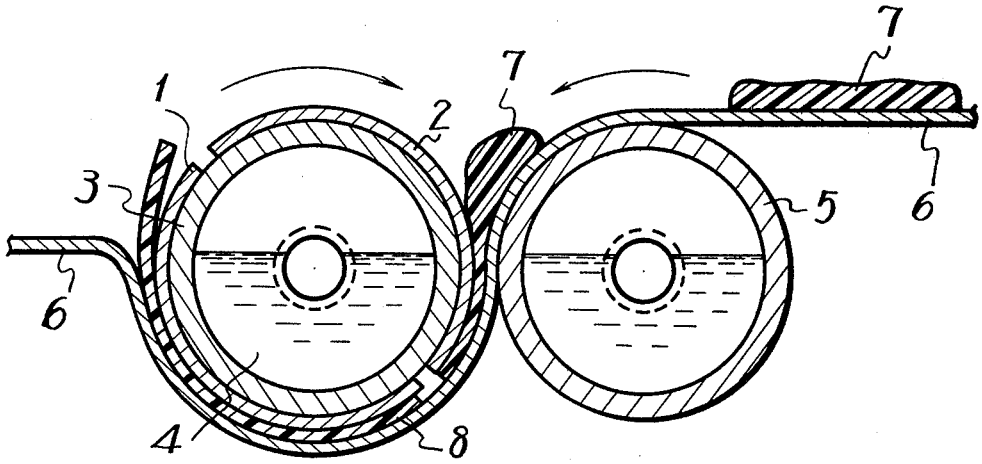

A description will next be given on embodiments of this invention with reference to FIGS. 2 and 3. Examples 1 and 2.

A paper matrix having type cavities made of a paper flong which has super strupping property for resin such as disclosed in Japanese utility model application publication No. 27601/1971 is selected as a paper matrix. Two paper matrices 1 and 2 as described above are mounted on a roll 3 of a diameter 600 mm with its inside being cooled by water 4 at a temperature of 20° C., while an impression roll 5 with a diameter same as that of the above mentioned roll 3 added with the thickness of the paper matrix is provided in opposition thereto. A steel belt 6 is inserted between these two rolls 3 and 5. The sum of the thickness of the steel belt 6, that of the paper matrix 1 or 2 at its thinnest portion, and 0.5 mm is set as the gap between these two rolls 3 and 5. The impression roll 5 is kept 70° C. in temperature. The rotary speed of the rolls 3 and 5 is adjusted so that the line-speed of the steel belt 6 may become 3.1 m/min.

On the moving steel belt 6 there are successively placed lumps 7 of crystalline polypropylene of MFI 8.1 containing 0.1 weight % of crystal nucleating agent, that is, p-tertbutylbenzoic acid monobasic aluminium salt in a sheet form of 1.2 mm thick. The above lumps 7 are transferred passed through a furnace (not shown) which can generate heat uniformly by an extreme infrared ray radiation heater. Thus heated material 7 is uniformly supplied to the clearance of two rolls 3 and 5 in a molten condition to be pressed therebetween. Then, thus casting reproduction printing plate is cooled by water of 20° C. from the outside through the steel belt 6 at a position where the matrix roll 3 makes substantially a quarter turn, and when another quarter turn is made, the reproduction printing plate 8 is peeled off from the paper matrix 1 or 2. The traveling speed of the steel belt 6 can be adjusted depending upon the above cooling and hardening condition.

The reproduction printing plate 8 was made at a reproduction speed of 3 plates/min with the paper matrix 1 or 2 being not damaged. Thus obtained result is shown in Table I.

TABLE I

| | Used crystalline polypropylene | | | | | | Number of reproduction plates per one paper matrix | |
|---|---|---|---|---|---|---|---|---|
| Examples | Basic Polymer | Ethylene content (weight %) | MFI (g/10 min) | Erucyl amide adding amount (weight %) | Tensile yield strength (kg/cm$^2$) | Temp. of molten resin (°C.) | When a type form is used as original plate for matrix | When etched pattern plates are used as original plate for matrix |
| 1 | ethylene-propylene random copolymer | 3.2 | 8.1 | 0.2 | 300 | 170 | 35 | 40 |
| 2 | ethylene-propylene random copolymer | " | " | — | 300 | " | 20 | 25 |
| Comparison 1 | propylene homopolymer | — | 8.0 | 0.2 | 400 | 215 | 10 | 15 |

From the above table, it will be noticed that when ethylene-propylene copolymer according to this invention is used, the matrix life is much superior than that when propylene homopolymer is used and also when erucylamide is added, the matrix life is further prolonged.

When a reproduction printing plate of ethylene-propylene copolymer prepared as above is mounted on a rotary press to print one hundred thousand newspapers at a speed of 130,000 copies per hour, there was no wear and beautiful printing finish was maintained.

EXAMPLES 3~6

On a steel belt of the same apparatus as those of the Examples 1 and 2, a sheet melt of crystalline polypropylene is extruded intermittently through a T die (not shown) from an accumulator coupled to an extruder to make a reproduction resin plate. The resut is shown in Table II.

TABLE II

| | Used crystalline polypyropylene | | | | | | | Number of reproduction plates per one paper matrix |
|---|---|---|---|---|---|---|---|---|
| Example | Basic polymer (copolymer is ethylene-propylene) | Ethylene Content (weight %) | MFI (g/10 min) | *1 Crystal nucleus agent (weight %) | Acid amide (weight %) | Tension yield strength (kg/cm$^2$) | Temp. of molten resin (°C.) | |
| 3 | block copolymer | 15.2 | 7.9 | 0.1 | Erucyl-amide 0.2 | 310 | 216 | 28 |

TABLE II-continued

| Example | Used crystalline polypyropylene: Basic polymer (copolymer is ethylene-propylene) | Ethylene Content (weight %) | MFI (g/10 min) | *1 Crystal nucleus agent (weight %) | Acid amide (weight %) | Tension yield strength (kg/cm²) | Temp. of molten resin (°C.) | Number of reproduction plates per one paper matrix |
|---|---|---|---|---|---|---|---|---|
| 4 | random copolymer | 3.2 | 8.1 | 0.1 | — | 300 | 210 | 25 |
| 5 | random copolymer | 3.2 | 8.1 | 0.1 | Erucyl-amide 0.2 | 300 | 210 | more than 40 |
| 6 | random copolymer | 6.0 | 7.7 | — | Erucyl-amide 0.2 | 265 | 190 | more than 30 |
| Comparison 2 | propylene homopolymer | — | 7.8 | 0.1 | — | 400 | 216 | 9 |
| Comparison 3 | propylene homopolymer | — | 7.8 | 0.1 | Erucyl-amide 0.2 | 400 | 216 | 14 |
| Comparison 4 | propylene homopolymer | — | 7.8 | 0.1 | oleyl-amide 0.2 | 400 | 216 | 13 |
| Comparison 5 | propylene homopolymer | — | 7.8 | 0.1 | Slearyl-amide 0.2 | 400 | 216 | 13 |
| Comparison 6 | propylene homopolymer | — | 7.8 | 0.1 | lubricat-ing silicon 0.2 | 400 | 216 | 9 |
| Comparison 7 | polyethylene-polypropylene blene *2 | 15 | 8.0 | 0.08 | — | 290 | 204 | 12 |
| Comparison 8 | polyethylene-polypropylene blend *3 | 30 | 8.2 | 0.07 | — | 240 | 210 | 11 |

REMARKS:
*1 Crystal nucleating agent used was P-tertbutyl-benzoicacid monobasic aluminum salt.
*2 Blend of 15 weight % of high-density polyethylene with MFI 9.2 and specific gravity 0.965 and 85 weight % of propylene homopolymer used in Comparison 2 was employed.
*3 Blend of 30 weight % of polyethylene same as that of *2 and 70 weight % of polypropylene was employed.

In this case, the steel belt was not cooled by water but cooled by spraying of compressed air of 18° C. and the temperature at the surface of paper matrices in operation was 45° ~ 60° C. Etched pattern plates were used as the original plate for matrix.

The result of Table II is rearranged as to the tensile yield strength as the graph of FIG. 1, from which it is noticed that the life of ethylene-propylene copolymer in a range of tensile yield strength under 330 kg/cm² is quite excellent. Further, it is apparent that the adding of acid amide much improves the pattern matrix life. As for the effect of acid amide, surface lubricating silicon was added to resin, but the pattern matrix life was not improved as shown in Comparison 6.

Further, a resin blended with polyethylene and propylene homopolymer in place of ethylene-propylene copolymer was used, but the life was not improved as shown in Comparisons 7 and 8.

It will be apparent that many modifications and variations could be effected by one skilled in the art without departing from the spirits or scope of the novel concepts of the present invention.

We claim as our invention:

1. A reproducing printing plate made by using a paper matrix, comprising a crystalline ethylene-propylene copolymer whose melt flow index is selected in a range of 3 ~ 10, which contains ethylene less than 20 weight % and which has the tensile yield strength of 220 ~ 330 kg/cm².

2. A reproducing printing plate made by using a paper matrix as claimed in claim 1 further comprising acid amide less than 1 weight %.

* * * * *